US008859905B2

(12) United States Patent
Frye

(10) Patent No.: US 8,859,905 B2
(45) **Date of Patent: *Oct. 14, 2014**

(54) WILDLIFE GUARD ASSEMBLIES AND METHODS FOR USING THE SAME

(75) Inventor: Terry Edward Frye, Cary, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 379 days.

This patent is subject to a terminal disclaimer.

(21) Appl. No.: 13/349,142

(22) Filed: Jan. 12, 2012

(65) Prior Publication Data

US 2012/0103681 A1 May 3, 2012

Related U.S. Application Data

(63) Continuation of application No. 12/575,335, filed on Oct. 7, 2009, now Pat. No. 8,115,102.

(51) Int. Cl.
*H01B 3/00* (2006.01)
*H01B 17/00* (2006.01)

(52) U.S. Cl.
CPC ..... *H01B 17/00* (2013.01)
USPC ..... 174/138 E; 174/139; 174/5 R; 174/5 SB; 29/592; 52/101

(58) Field of Classification Search
CPC ..... H02G 3/02; H02G 3/0468; H01B 17/00
USPC ..... 174/138 E, 139, 5 R, 140 R, 151, 5 SB; 52/101; 48/58; 361/604; 285/42
See application file for complete search history.

(56) References Cited

U.S. PATENT DOCUMENTS 1,766,636 A 6/1930 Holzel
2,099,540 A 11/1937 Smith
(Continued)

FOREIGN PATENT DOCUMENTS

DE 3528771 2/1987
FR 2307352 11/1976
(Continued)

OTHER PUBLICATIONS

Notification of Transmittal of the International Search Report and the Written Opinion of the International Searching Authority, or the Declaration in corresponding PCT Application No. PCT/US2010/051286 mailed Mar. 23, 2011, 8 pages.

(Continued)

*Primary Examiner* — Dhirubhai R Patel
(74) *Attorney, Agent, or Firm* — Myers Bigel Sibley & Sajovec, P.A.

(57) ABSTRACT

A wildlife guard assembly for use with an electrical insulator body includes first and second guard members and an actuator member. The first and second guard members define a seat to receive the insulator body and are connected to one another to permit relative movement between an open position. The first and second guard members define a sideward opening to laterally receive the insulator body into the seat, and a closed position, wherein the first and second guard members at least partially encircle the insulator body to capture the insulator body in the seat. The actuator member is configured to be inserted between the first and second guard members in the open position and, when forcibly displaced radially to an installed position, to force the first and second guard members to move from the open position to the closed position.

19 Claims, 10 Drawing Sheets

(56) References Cited

U.S. PATENT DOCUMENTS

| | | | | |
|---|---|---|---|---|
| 2,234,391 | A | 3/1941 | Taylor | |
| 2,617,378 | A | 11/1952 | Osol | |
| 2,999,479 | A | 9/1961 | Carder | |
| 3,005,436 | A | 10/1961 | Caldwell | |
| 3,016,034 | A | 1/1962 | Raistakka | |
| 3,056,376 | A | 1/1962 | Bender | |
| 4,053,707 | A | 10/1977 | Ely et al. | |
| 4,201,883 | A | 5/1980 | Shepherd | |
| 4,243,628 | A | 1/1981 | Herold | |
| 4,467,387 | A | 8/1984 | Bergh et al. | |
| 4,637,164 | A | 1/1987 | Brown | |
| 4,731,507 | A | 3/1988 | Torimoto et al. | |
| 5,023,406 | A | 6/1991 | Thornley | |
| 5,293,721 | A | 3/1994 | Richard et al. | |
| 5,293,835 | A | 3/1994 | Shagoury | |
| 5,347,769 | A | 9/1994 | Dinsmore | |
| 5,446,242 | A | 8/1995 | Barrett | |
| 5,525,073 | A | 6/1996 | Sampson | |
| 5,679,922 | A | 10/1997 | Harben | |
| 5,682,015 | A | 10/1997 | Harben | |
| 5,834,686 | A | 11/1998 | Barrett et al. | |
| 5,864,096 | A | 1/1999 | Williams et al. | |
| 6,005,196 | A | 12/1999 | Spillyards | |
| 6,098,348 | A | 8/2000 | Weaver | 52/101 |
| D432,742 | S | 10/2000 | Puigcerver et al. | |
| 6,248,956 | B1 * | 6/2001 | Cook et al. | 174/155 |
| 6,255,597 | B1 * | 7/2001 | Bowling et al. | 174/138 F |
| 6,571,517 | B2 | 6/2003 | Wulff et al. | |
| 6,878,883 | B1 | 4/2005 | Rauckman | |
| 6,963,025 | B1 | 11/2005 | Kysely | 174/5 R |
| 6,995,313 | B1 * | 2/2006 | Barnett et al. | 174/5 R |
| 7,075,015 | B1 | 7/2006 | Rauckman | |
| 7,276,665 | B1 | 10/2007 | Rauckman | |
| 7,309,837 | B1 | 12/2007 | Rauckman | |
| 7,541,546 | B2 | 6/2009 | Vojtila et al. | |
| 2003/0015330 | A1 | 1/2003 | Wood et al. | |
| 2008/0289856 | A1 | 11/2008 | Rauckman | |

FOREIGN PATENT DOCUMENTS

| | | | |
|---|---|---|---|
| WO | WO 92/08237 | A1 | 5/1992 |
| WO | WO 96/16416 | A1 | 5/1996 |
| WO | WO 97/34306 | A1 | 9/1997 |

OTHER PUBLICATIONS

Derwent Abstract WPI Acc. No. 93-062781 (1993) and JAPIO abstract No. 04021243 (abstracts of Chubu Elec. & Furukawa Elec., JP 05-012943 (1993).

IEEE Standard No. 1264-1993, "IEEE Guide for Animal Deterrents for Electric Power Supply Substations", Jan. 3, 1996.

Patent Abstract of Japan, vol. 13, No. 109 (E-727), Mar. 19, 1989 (abstract of Chubu Elec. Power Co., JP 63-281323 (1988).

"BISG II Bus insulator squirrel guard" Bus Insulation and Wildlife Protection Products, Tyco Electronics Corporation, http://energy.tycoelectronics.com, Issued 2004-2005, 1 page.

"Rauckman Wildlife Shield™ Installation Guide" Rauckman Utility Products, LLC, U.S. Patent No. 5,864,096, RUPWS3003A, (2003), 6 pages.

* cited by examiner

WILDLIFE GUARD ASSEMBLIES AND METHODS FOR USING THE SAME

RELATED APPLICATION(S)

The present application is a continuation application claiming priority from U.S. patent application Ser. No. 12/575,335, filed Oct. 7, 2009, now U.S. Pat. No. 8,115,102 which is hereby incorporated herein by reference in its entirety.

FIELD OF THE INVENTION

The present invention relates to protective guards and, more particularly, to wildlife guards for power distribution lines and associated insulators.

BACKGROUND OF THE INVENTION

Electrical equipment, such as power transmission lines, insulators, surge arrestors, switchgear and transformers (e.g., operating at voltages in excess of 1 kV and particularly in excess of 10 kV, such voltages hereinafter being referred to as "high voltage"), often have parts thereof or parts associated therewith that are not insulated from the surrounding air. Thus, an exposed portion of such equipment can be at high voltage and be longitudinally separated from another portion at low voltage, for example at earth potential. The exposed high voltage portion may be physically supported by an insulator, for example when an overhead power line is mounted on an insulator that spaces it from a supporting tower that is itself at earth potential, or for example when a high voltage cable is terminated at a bushing or switchgear whose metal housing is at earth potential. In such instances outdoors, larger wildlife such as squirrels and birds with large wingspans may be big enough to form a direct bridge (i.e., an electrical short circuit) between the high voltage equipment and earth potential, with serious, usually fatal, consequences for themselves and often with serious consequences for the electrical equipment and the supply of electrical power—usually at least a fuse is actuated or a circuit breaker triggered such that the power supply is interrupted.

One known solution to the foregoing problem is to install a wildlife guard that may be referred to as a "squirrel guard". Typically, a wildlife guard includes one or more parts forming a disk with an aperture. The wildlife guard is mounted on an insulator (e.g., between sheds) such that the disc extends radially outwardly from the insulator beyond the sheds. The wildlife guard substantially increases the distance from earth potential to the high voltage equipment so that wildlife are prevented from simultaneously making contact with each of, and thereby bridging, earth potential and the high voltage equipment.

Wildlife guards of known design may be difficult or cumbersome to install on elevated insulators by an installer situated on the ground using a hotstick, for example. It is desirable that a wildlife guard be securely mounted on an insulator once installed.

SUMMARY OF THE INVENTION

According to embodiments of the present invention, a wildlife guard assembly for use with an electrical insulator body includes first and second guard members and an actuator member. The first and second guard members define a seat to receive the insulator body and are connected to one another to permit relative movement between an open position. The first and second guard members define a sideward opening to laterally receive the insulator body into the seat, and a closed position, wherein the first and second guard members at least partially encircle the insulator body to capture the insulator body in the seat. The actuator member is configured to be inserted between the first and second guard members in the open position and, when forcibly displaced radially to an installed position, to force the first and second guard members to move from the open position to the closed position.

According to method embodiments of the present invention, a method for installing a wildlife guard assembly on an electrical insulator body includes providing a wildlife guard assembly. The wildlife guard assembly includes first and second guard members and an actuator member. The first and second guard members define a seat to receive the insulator body and are connected to one another to permit relative movement between an open position, wherein the first and second guard members define a sideward opening to laterally receive the insulator body into the seat, and a closed position, wherein the first and second guard members at least partially encircle the insulator body to capture the insulator body in the seat. The method further includes: with the first and second guard members in the open position, placing the first and second guard members on the insulator body such that the insulator body is received laterally through the sideward opening into the seat; and thereafter, with the first and second guard members guard members mounted on the insulator body in the open position and the actuator member inserted between the first and second guard members, forcing the actuator member radially to an installed position and thereby forcing the first and second guard members to move from the open position to the closed position.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE INVENTION

Figure 1:
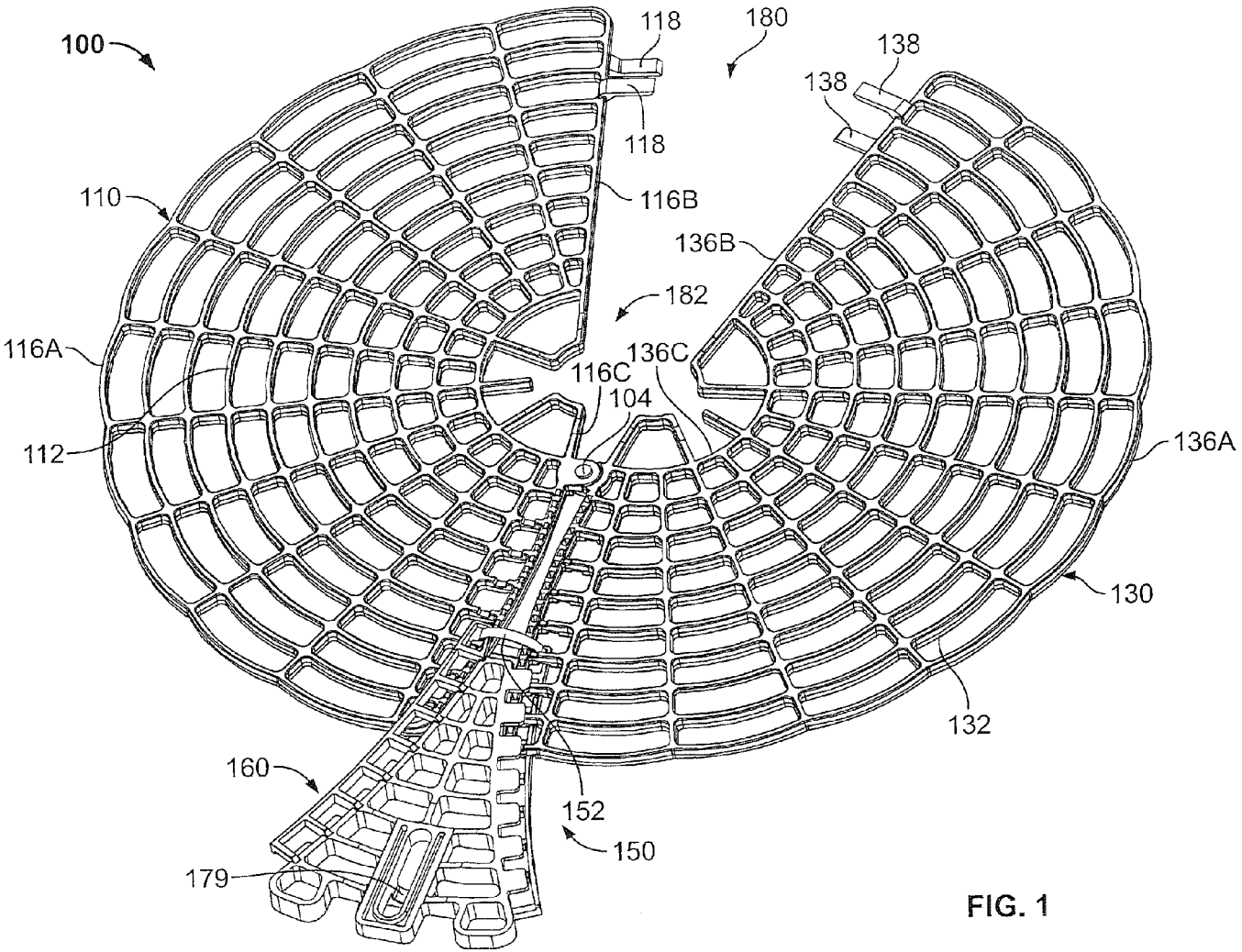
FIG. 1 is a top, rear perspective view of a wildlife guard assembly according to embodiments of the present invention in an open position.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90° or at other orientations) and the spatially relative descriptors used herein interpreted accordingly.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

Figure 5:
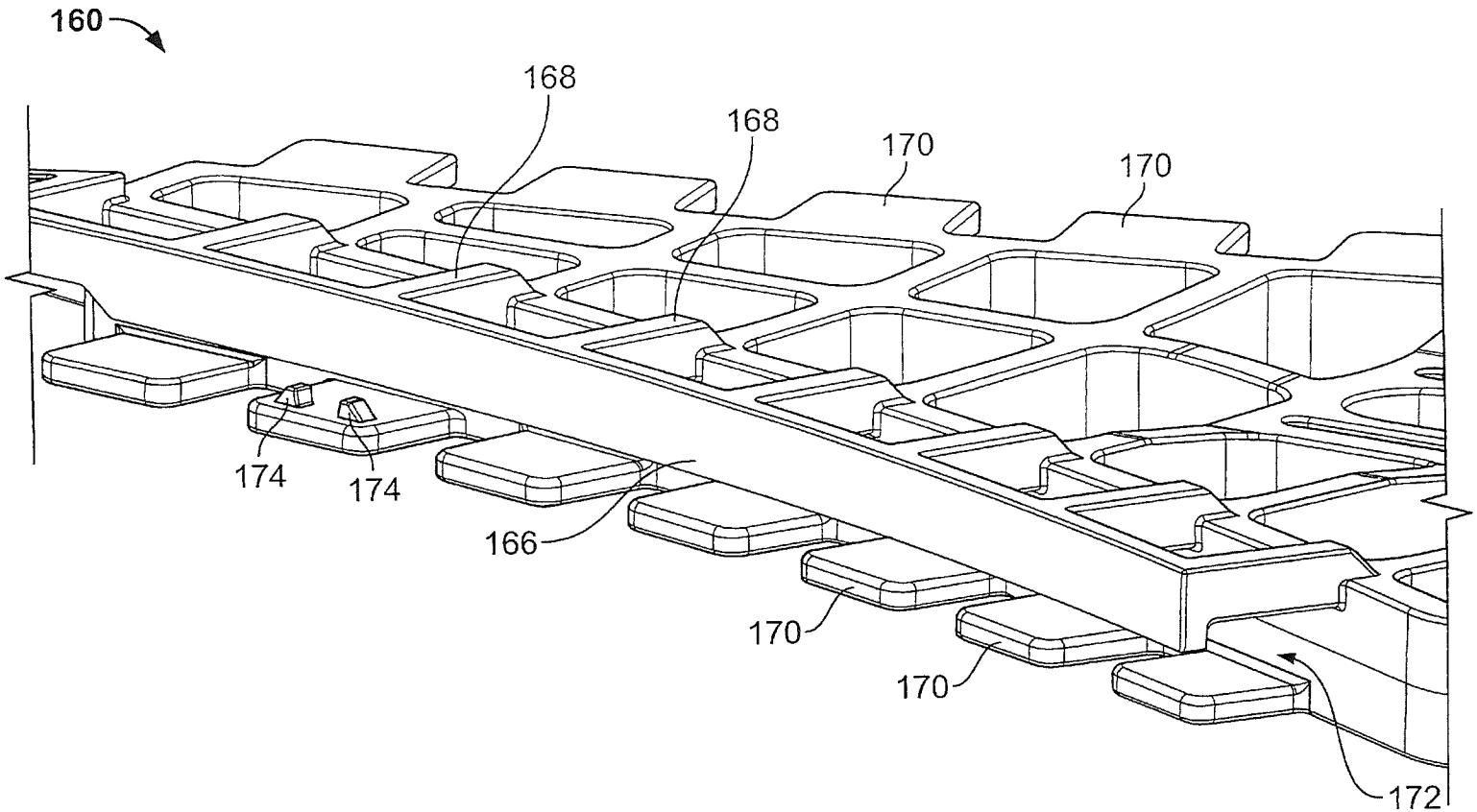
FIG. 5 is an enlarged, fragmentary, perspective view of an actuator member of the wildlife guard assembly of FIG. 1.
Figure 6:
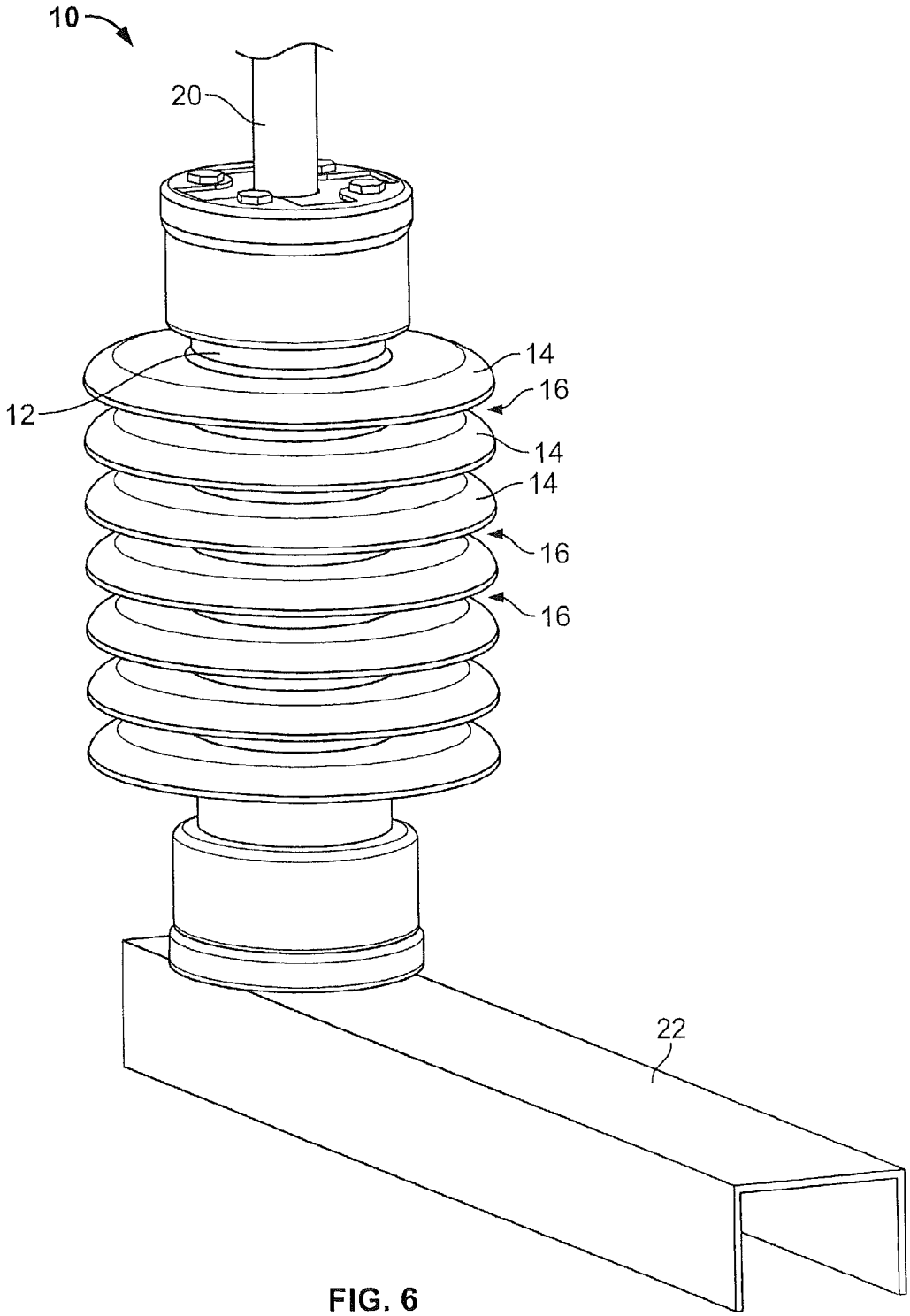
FIG. 6 is a perspective view of an exemplary insulator bushing and a support for use with the wildlife guard assembly of FIG. 1.
Figure 7:
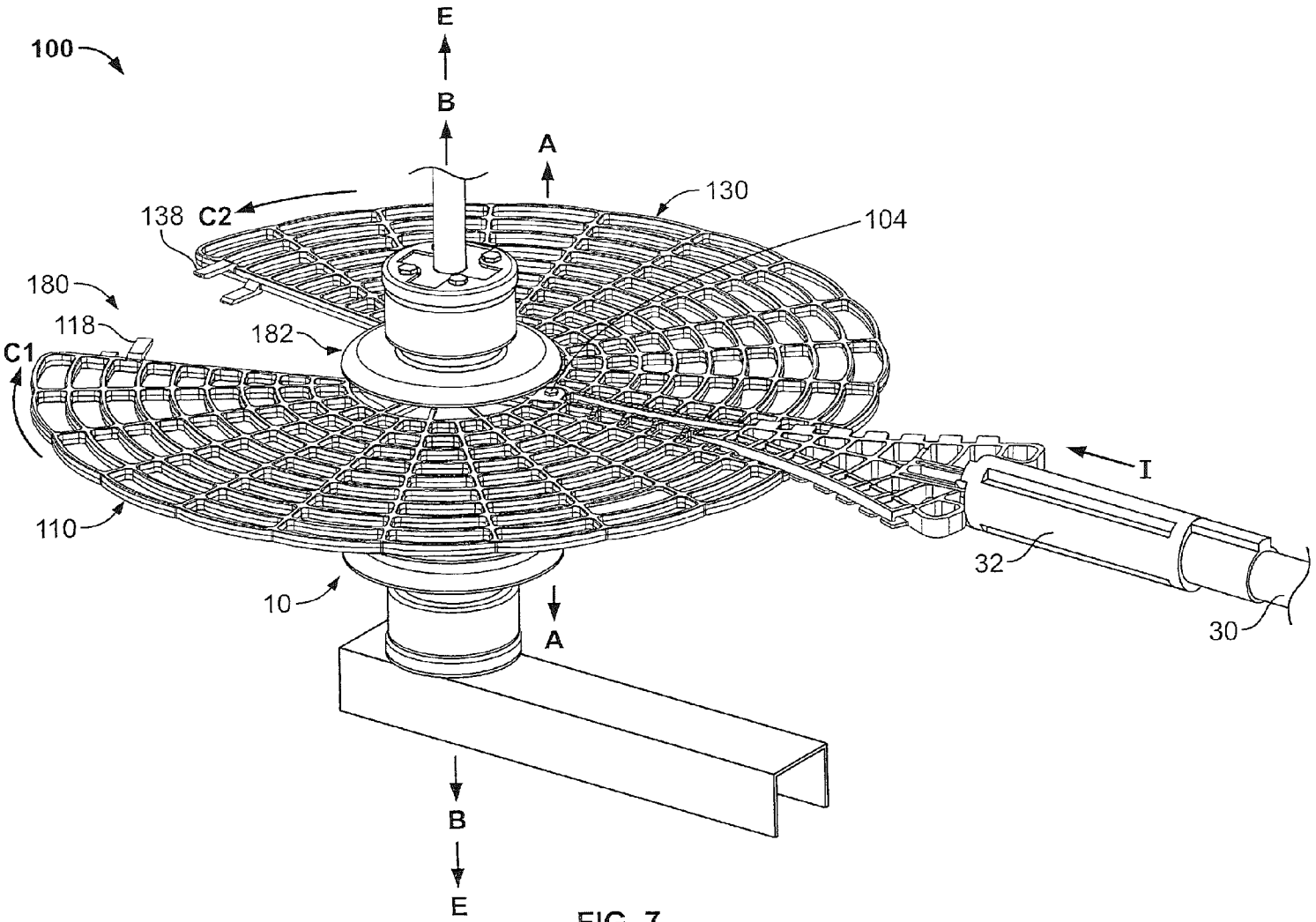
FIGS. 7 and 8 illustrate methods according to embodiments of the present invention for installing the wildlife guard assembly of FIG. 1 on the insulator bushing of FIG. 6.
Figure 8:
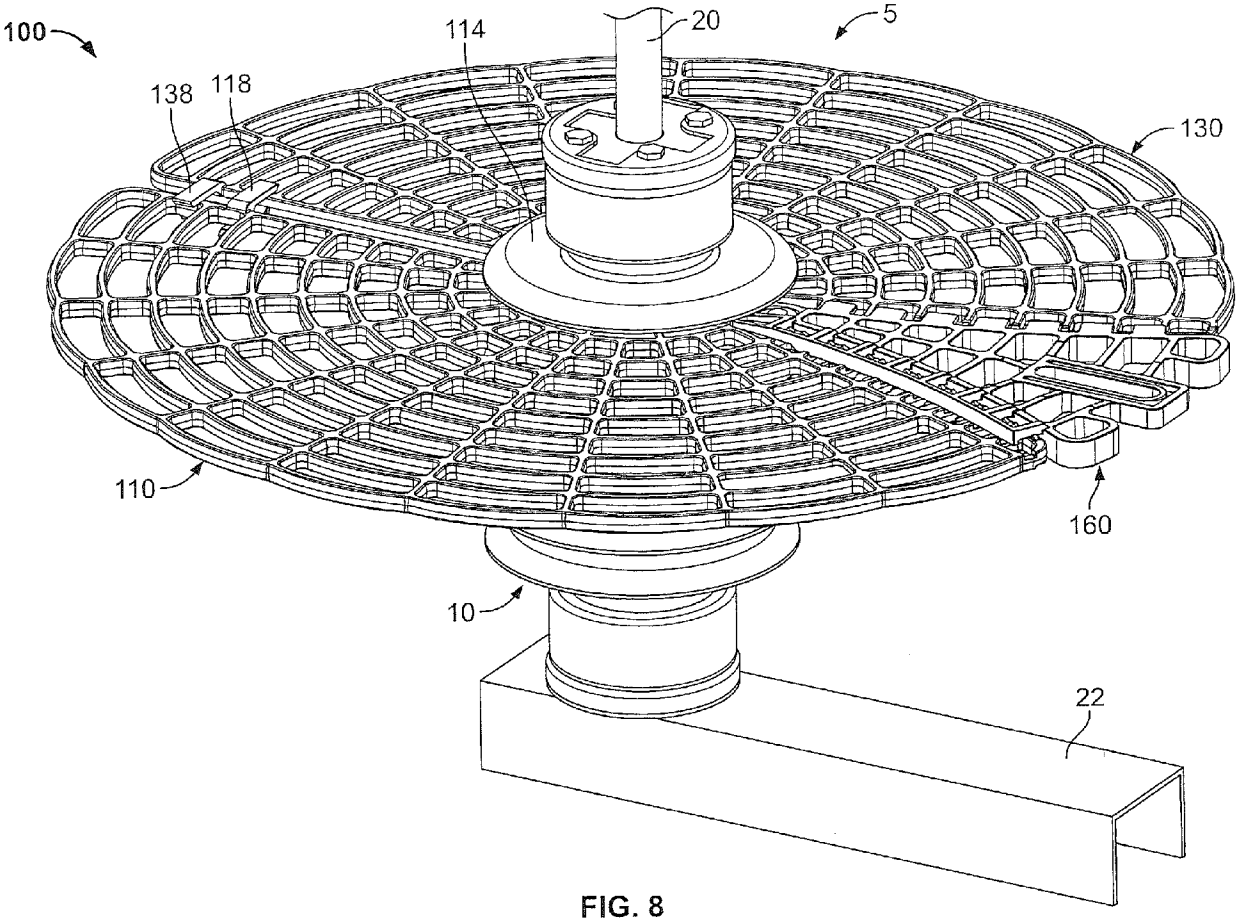

With reference to FIGS. 1-9, a wildlife guard assembly 100 according to embodiments of the present invention is shown therein. The wildlife guard assembly 100 may be used with an electrical insulator body such as the electrical insulator bushing 10 as shown in FIG. 6 to form protected electrical equipment 5 (FIG. 8). In the illustrated embodiment, an energized electrical conductor 20 extends from the bushing 10 and the bushing 10 is mounted on a support 22. The bushing 10, which is typically formed of porcelain or other electrically insulative material, electrically shields the conductor 20 from the support 22 and/or other electrically conductive components (e.g., which may be at earth potential). When installed on the bushing 10, the wildlife guard assembly 100 extends radially outwardly from the bushing 10 and serves to enlarge or extend the shortest distance between the components at significantly different electrical potential (i.e., the conductor 20 and the support 22) that can be bridged by wildlife such as squirrels or large birds. That is, the wildlife guard assembly 100 has a diameter greater than the bushing 10 so that the wildlife guard assembly 100 provides an effective barrier or obstacle to wildlife prostrating themselves from earth to high voltage.

As discussed in more detail below, the wildlife guard assembly 100 can be applied to the bushing 10 using one or more manipulator tools (such as hotsticks or the like) while the conductor 20 is energized. According to some embodiments, the wildlife guard assembly 100 can be mounted and secured on the bushing 10 by a single operator using only a single hotstick.

Figure 2:
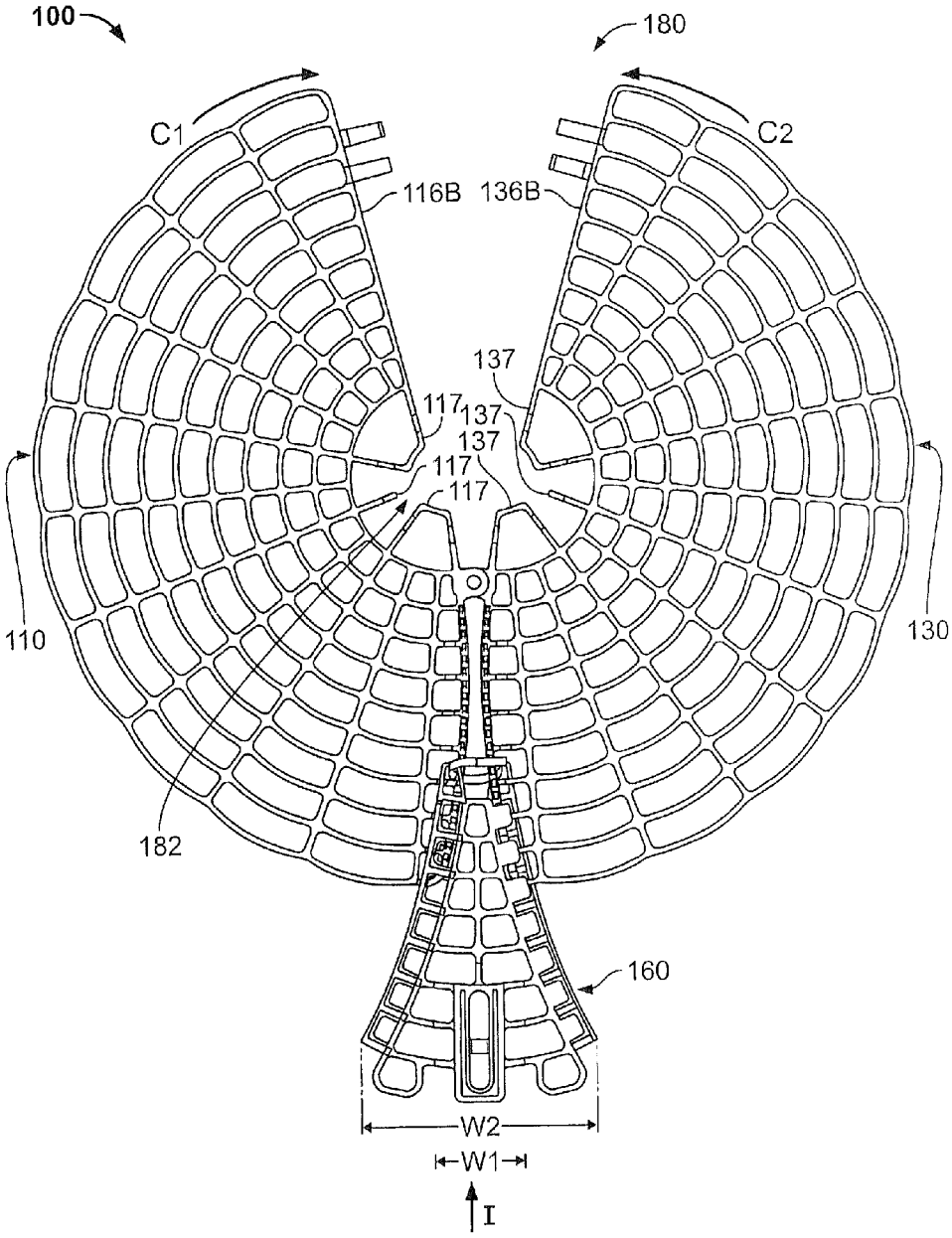
FIG. 2 is a top plan view of the wildlife guard assembly of FIG. 1 in the open position.

Turning to the wildlife guard assembly 100 in more detail and with reference to FIG. 1, the wildlife guard assembly 100 includes a first guard member 110, a second guard member 130, a pivot pin 104 and an actuator member 160 (forming a part of an actuator mechanism 150). Generally, the guard members 110, 130 can be pivoted or rotated about the pivot pin 104 about an axis A-A (FIG. 7) from an open position (as shown in FIGS. 1 and 7) to a closed position (as shown in FIG. 8) by forcing the actuator member 160 in an installation direction I from a ready position (as shown in FIGS. 1, 2 and 7) to an installed position (as shown in FIG. 8). The guard members 110, 130 may remain co-planar or in substantially parallel planes as they pivot from the open position to the closed position.

Figure 3:
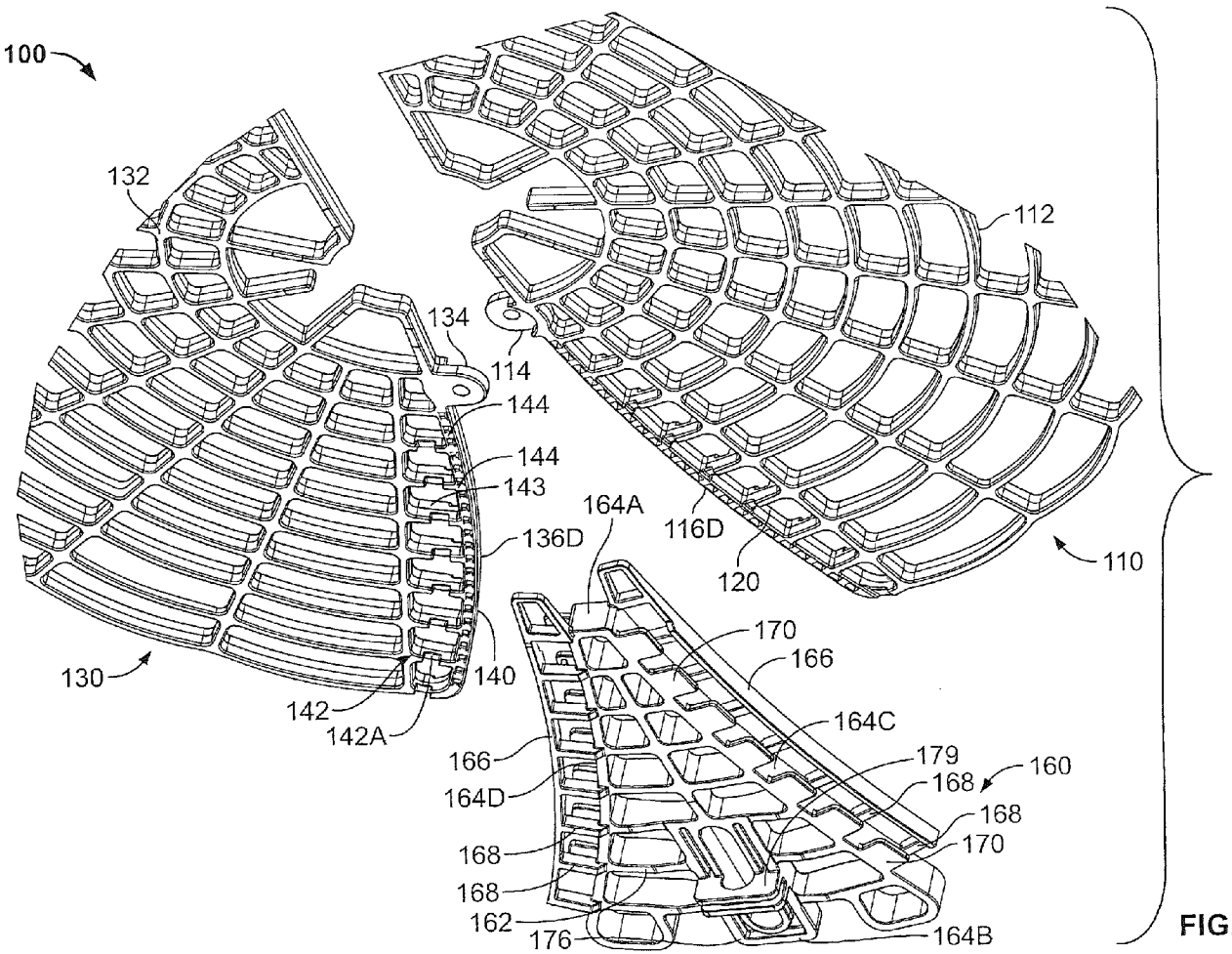
FIG. 3 is an exploded, bottom perspective view of the wildlife guard assembly of FIG. 1.
Figure 4:
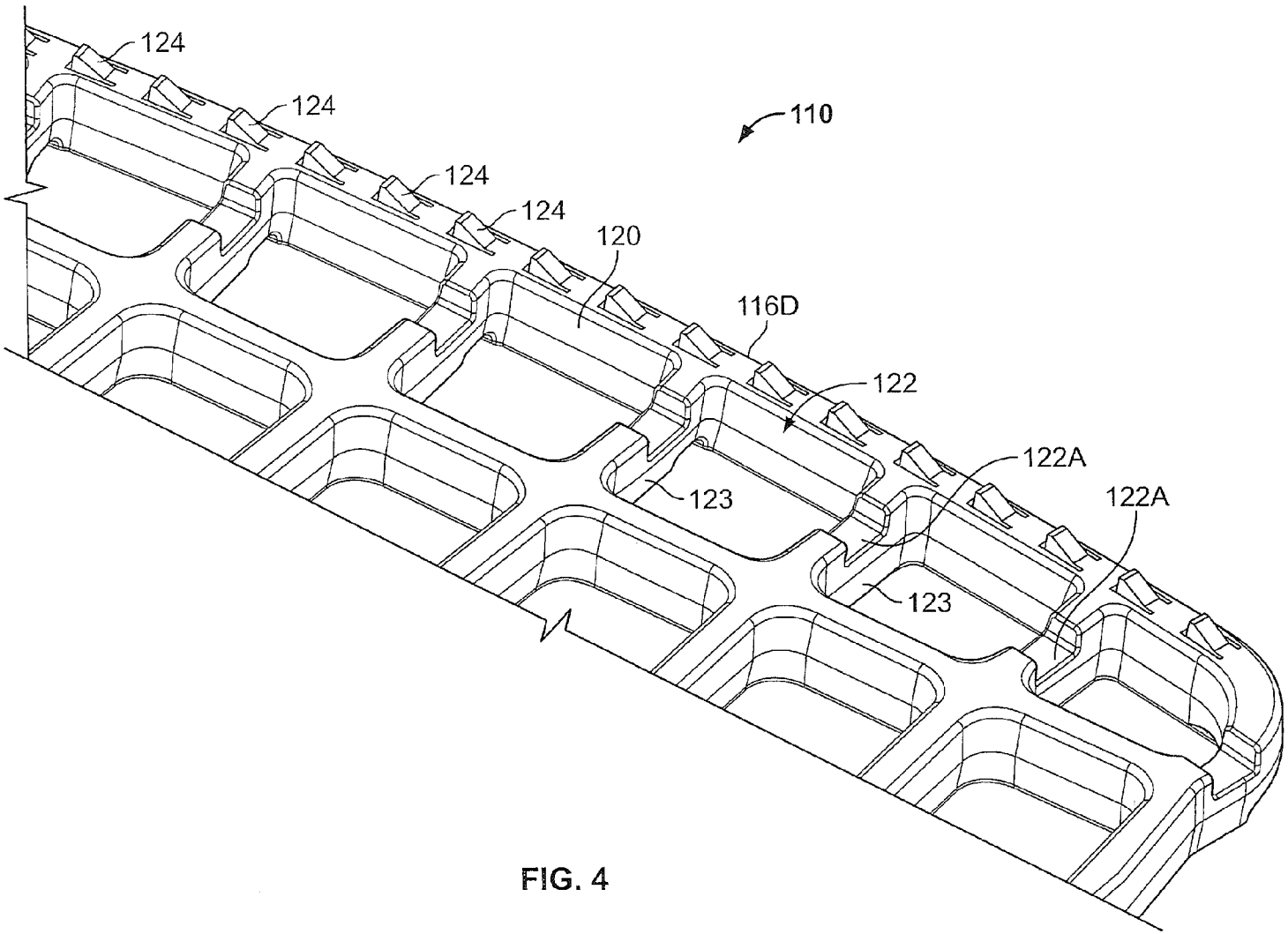
FIG. 4 is an enlarged, fragmentary, perspective view of a guard member of the wildlife guard assembly of FIG. 1.

The guard member 110 includes a guard body 112, a hinge feature 114 (FIG. 3), an outer peripheral edge 116A, a front terminal edge 116B, an inner peripheral edge 116C and a rear terminal edge 116D (FIG. 3). The guard body 112 may take the form of an interconnected network of legs forming a grate as illustrated, for example. Removable or trimmable sections or features 117 (FIG. 2) are provided along the inner peripheral edge 116C. Alignment or stabilizer features 118 extend from the front terminal edge. A rail 120 (FIG. 3) extends along the rear terminal edge 116D. A plurality of grooves 122A (FIG. 4) are defined in crossbars 123 of the guard member 110 and collectively define a groove 122. A series of integral barbs 124 (FIG. 4) are positioned along the length of the rail 120.

With reference to FIGS. 1-3, the guard member 130 includes elements 132, 134, 136A, 136B, 136C, 136D, 137, 138, 140, 142, 142A, 143, and 144 corresponding to elements 112, 114, 116A, 116B, 116C, 116D, 117, 118, 120, 122, 122A, 123 and 124, respectively, of the guard member 110. The guard member 130 may be identical to the guard member 110 or a mirror image thereof. The guard member 130 is coupled or fastened to the guard member 110 by the pivot pin 104 and the hinge features 114, 134.

With reference to FIG. 3, the actuator member 160 includes an actuator body 162 having a leading end 164A, a trailing end 164B, and opposed side walls 164C and 164D. Guide rails 166 are joined to the body 162 by crossbars 168 and extend along the side walls 164C and 164D in spaced apart relation. A series of tabs 170 also extend from each of the side walls 164C, 164D and are spaced apart above or below the adjacent rail 166 and crossbars 168 to define respective channels 172 (FIG. 5). According to some embodiments and as illustrated, the side walls 164C, 164D and the side rails 166 are curvilinear and, according to some embodiments, define a substantially uniform arc. Retention features or projections 174 (FIG. 5) are provided on the sides of forward tabs 170 facing the corresponding rails 166. A handling feature 176 is provided on the trailing end of the actuator member 160. A further handling feature 179 (e.g., in the form of a loop or eyelet) depends from the actuator member 160 as well (FIG. 3).

The actuator member 160 is mounted on the guard members 110, 130 such that a leading portion of the actuator member 160 is interlocked with the features adjacent the rear terminal edges 116D, 136D. More particularly, the rails 120, 140 of the guard members 110, 130 are slidably captured in the channels 172 (defined by the tabs 170 and the crossbars 168 and rails 166), the rails 166 are seated in the channels 122, 142, and the side walls 164C and 164D are positioned adjacent (and may abut) the rear terminal edges 116D and 136D, respectively. As shown in FIG. 1, the actuator member 160 is in the ready position and releasably secured in this position by the retention features 174 (FIG. 5), which capture a crossbar 123, 143 of each guard member 110, 130. Additionally or alternatively, a frangible or cuttable tie wrap 152 (FIG. 1) may secure the actuator member 160 in place.

In the closed position, the guard member 110, the guard member 130 and the actuator member 160 form a substantially planar structure. As illustrated, the wildlife guard assembly 100 is generally disc-shaped. However, it will be appreciated that other shapes may be employed for the guard member 110, the guard member 130 or the wildlife guard assembly 100 overall.

The inner peripheral edges 116C, 136C of the guard members 110, 130 collectively define a seat 182. With the actuator member 160 mounted in the ready position, the guard members 110, 130 are retained in the open position (FIG. 1) such that a sideward opening 180 is defined between the spaced apart edges 116B, 136B and communicates with the seat 182.

The wildlife guard assembly 100 has a central axis E-E (FIG. 7), which may be substantially centered in the seat 182 when the wildlife guard assembly 100 is in the closed position. The installation direction I (FIG. 7) is transverse to and may be radial to the axis E-E. In some embodiments and as illustrated, the installation direction I is substantially perpendicular to the axis E-E. The actuator 160 is located on the same side of the seat 182 as the pivot axis A-A.

The guard member 110, the guard member 130 and the actuator member 160 may be formed of any suitable electrically insulative material. The material may be weather resistant. According to some embodiments, the guard member 110, the guard member 130 and the actuator member 160 are formed of a polymeric material. According to some embodiments, the guard members 110, 130 and the actuator 160 are formed of a track resistant, insulating grade, UV stable polymer. The guard members 110, 130 and the actuator 160 may be formed of the same or different materials. The components 110, 130, 160 may be formed of a rigid or semi-rigid material. In some embodiments, the material has a secant modulus of at least 25,000 psi and/or a tensile strength of from about 1200 to 2500 psi. According to some embodiments, the guard member 110, the guard member 130 and the actuator member 160 are each integrally formed and, according to some embodiments, each are unitarily molded (e.g., injection molded).

With reference to FIGS. 6-8, the wildlife guard assembly 100 may be mounted on the bushing 10 in the following manner in accordance with embodiments of the present invention. The removable sections 117, 137 (FIG. 2) may be removed or trimmed as needed depending on the size of the bushing 10. The actuator 160 may be premounted on the guard members 110, 130 as shown and described.

The insulator bushing 10 (FIG. 6) is merely exemplary and includes an elongated core 12 having a core axis B-B (FIG. 7). The core 12 may be substantially cylindrical. A plurality of axially spaced apart skirts or sheds 14 extend radially outwardly from the core 12 and define slots or gaps 16 therebetween. While the insulator body is shown and described as an insulator bushing, the wildlife guard assembly 100 may be used with other types of insulator bodies such as surge arrestors, switch insulators, or support insulators.

As shown in FIG. 7, the wildlife guard assembly 100 may be lifted and positioned on the bushing 10 using a hotstick 30 having a selectively operable gripper mechanism 32. Suitable hotsticks may include the Model 8112 Shotgun Stick available from Hastings Fiber Glass Products, Inc. of Hastings, Mich. The installer can grip the handling feature 176, lift the wildlife guard assembly 100 and laterally push (i.e., in the direction I) the wildlife guard assembly 100 between the selected skirts 14 of the bushing 10 until the core 12 is in the seat 182. More particularly, the bushing 10 is received through the opening 180 and into the seat 182.

Once the wildlife guard assembly 100 is so positioned, the installer continues to force the actuator member 160 radially inwardly in the direction I. Because the guard members 110, 130 abut the hushing core 12 the actuator member 160 (after overcoming the resistance of the retention features 174 and the tie wrap 152, if present) will push laterally into the space between the guard members 110, 130. In this manner, the side walls 164C, 164D progressively bear against the edges 116D, 136D of the guard members 110, 130 to force the guard members 110, 130 to rotate about the pivot axis A-A of the pivot pin 104 and the core 12 in opposed, convergent directions C1, C2 until the actuator member 160 achieves the installed position (FIG. 8), whereupon the front edges 116B, 136B of the guard members 110, 120 are in close proximity to close the opening 180 and secure the core 12 in the seat 182. The inner portions of the guard members 110, 130 reside in the selected slot 16 between the skirts 14 to prevent vertical removal of the wildlife guard assembly 100 from the bushing 10. According to some embodiments, the installed wildlife guard assembly 100 is substantially coaxial with the bushing 10. The wildlife guard assembly 100 may snugly fit about the core 12. The hotstick 30 can then be removed.

In some embodiments and as shown, the guard members 110, 130 and the actuator 160 collectively form a disc that fully or substantially fully encircles the core 12. The actuator 160 can extend at least to or proximate the outer perimeter of the guard members 110, 130 to fill the gap therebetween.

The actuator member 160 is secured in the installed position by the barbs 124, 144, which interlock with the crossbars 168 of the actuator member 160 to resist detachment. According to some embodiments, the wildlife guard assembly 100 can be removed from the bushing 10 by twisting and/or drawing back on the actuator member 160 to defeat the interlock.

As shown in FIG. 8, the stabilizer features 118, 138 may assist in aligning the guard members 110, 130 as they come together and to torsionally stabilize the guard members 110, 130 against warping. The engagements between the rails 120, 140, the tabs 170, the crossbars 168 and the rails 166 can prevent or resist torsion or warping of the wildlife guard assembly 100 at the junctions between the actuator 160 and the guard members 110, 130.

Notably, the wildlife guard assembly 100 may be installed by a single installer using a single hotstick.

Figure 9:
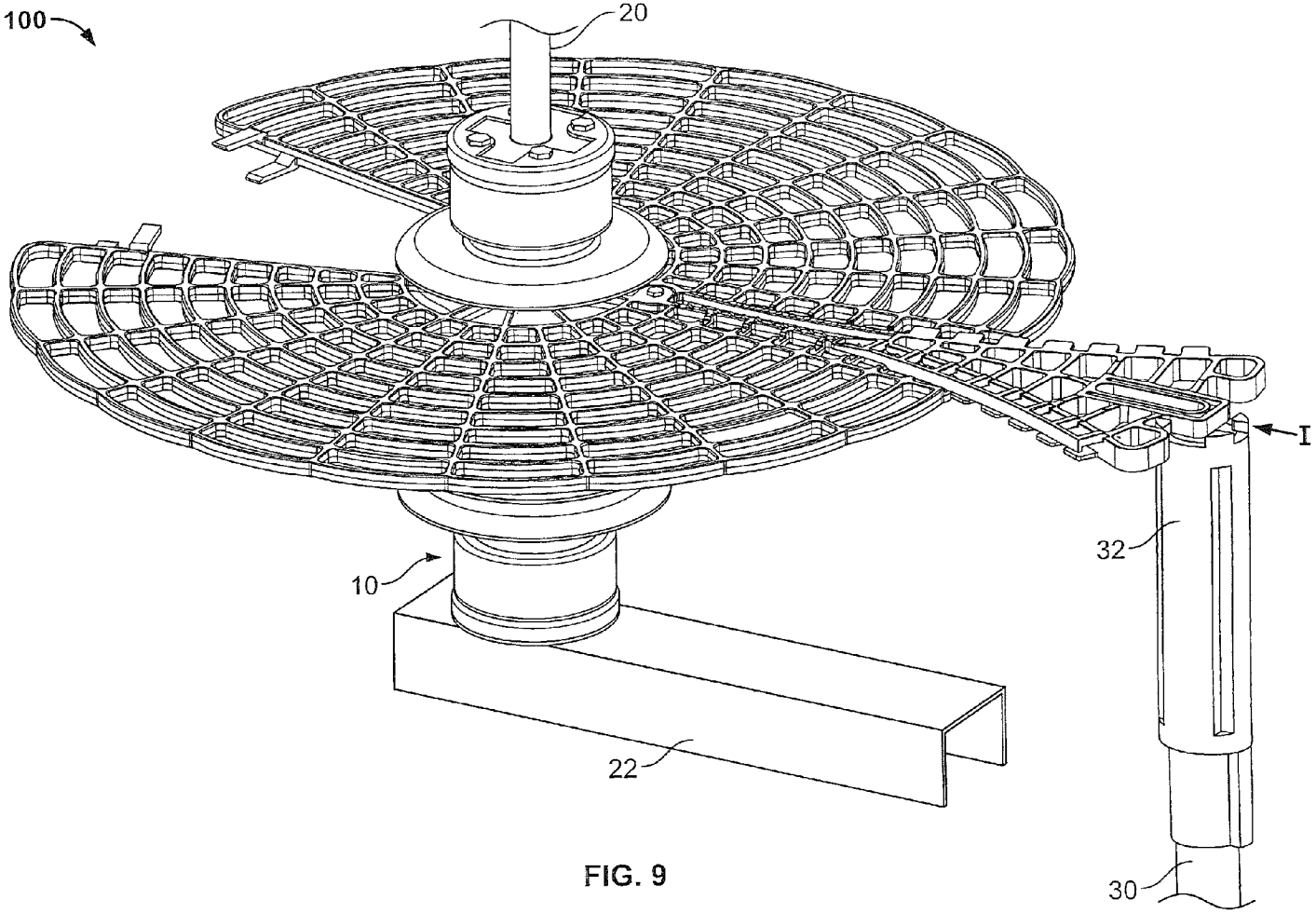
FIG. 9 illustrates alternative methods according to embodiments of the present invention for installing the wildlife guard assembly of FIG. 1 on the insulator bushing of FIG. 6.

FIG. 9 illustrates installation of the wildlife guard assembly 100 using a hotstick 30 from a different orientation or installer location. In this case, the installer can engage the handling feature 179 (FIG. 3) of the actuator member 160 with a hook of the gripper mechanism 32, for example.

According to some embodiments, the width W2 (FIG. 2) between the side walls 164C, 164D at the trailing end 164B is greater than the width W1 between the side walls 164C, 164D at the leading end 164A. According to some embodiments, the width W2 is at least 700 percent greater than the width W1.

According to some embodiments, the outer diameter of the wildlife guard assembly 100 when closed is between about 200 and 600 percent greater than the outer diameter of the skirts 14. According to some embodiments, the outer diameter of the wildlife guard assembly 100 when closed is in the range of from about 59 to 62 cm.

Figure 10:
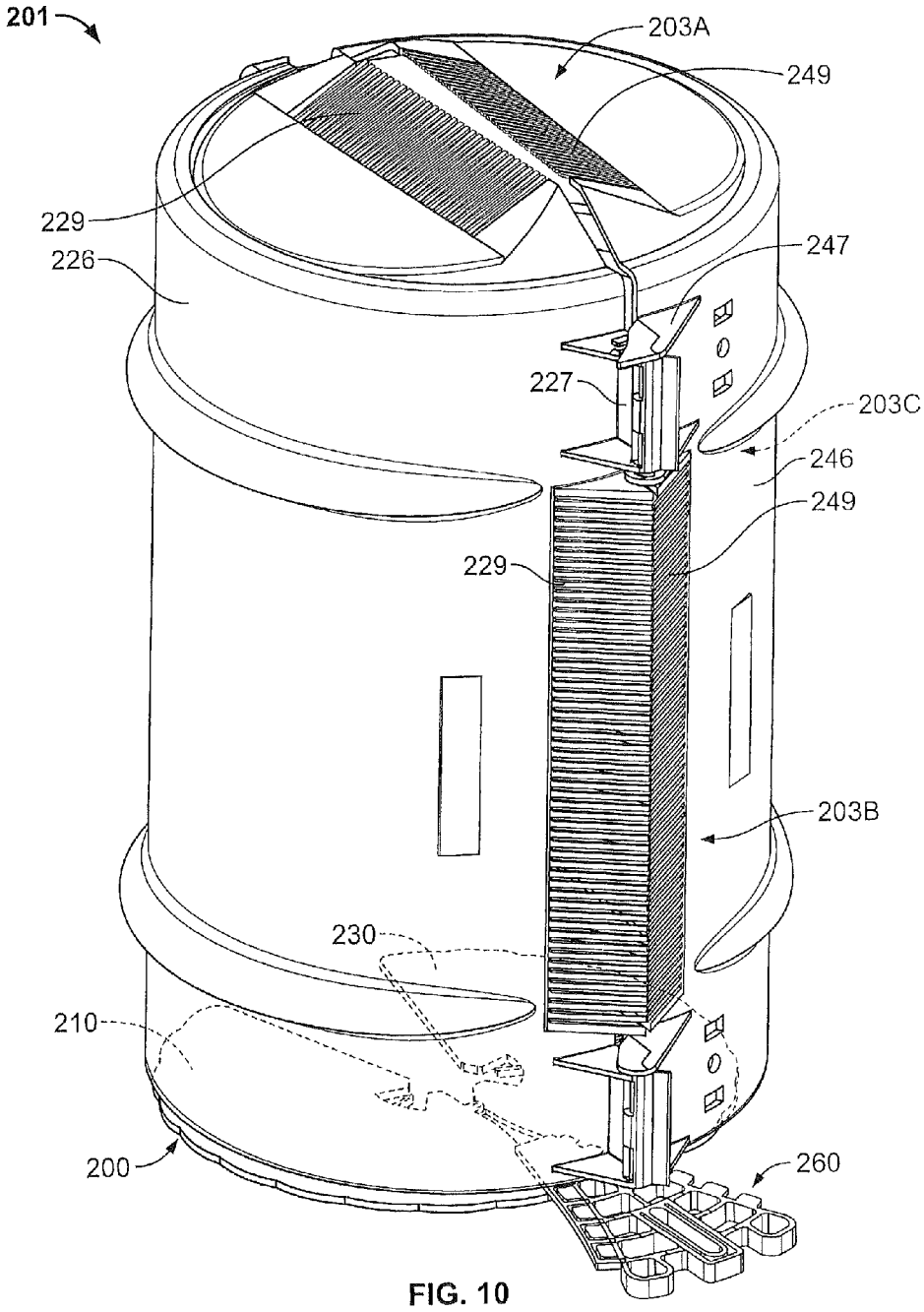
FIG. 10 is a top, rear perspective view of a wildlife guard assembly according to further embodiments of the present invention.

With reference to FIG. 10, a wildlife guard assembly 201 according to further embodiments of the present invention is shown therein. The wildlife guard assembly 201 includes a base assembly 200 corresponding to the wildlife guard assembly 100 and having a guard member 210, a guard member 230, and an actuator member 260 corresponding to guard member 110, the guard member 130, and the actuator member 160, respectively. The wildlife guard assembly 201 further includes shell bodies 226 and 246 secured to or integrally formed with the guard members 210 and 230, respectively, hinge features 227, 247, and displaceable conductor port walls 229, 249. When closed, the shell bodies 226, 246 define an interior chamber 203C to hold a portion of the insulator body and conductor ports 203A, 203B for the passthrough of electrical conductors to the enclosed insulator body. The wildlife guard assembly 201 may be installed in the same manner as discussed above with regard to the wildlife guard assembly 100.

Integral or separate latch structures may be provided on the front end of the guard members 110, 130 in addition to or in place of the stabilizer features 118, 138.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A wildlife guard assembly for use with an electrical insulator body, the wildlife guard assembly comprising:

first and second guard members defining a seat to receive the insulator body, the first and second guard members being connected to one another to permit relative movement between an open position, wherein the first and second guard members define a sideward opening to laterally receive the insulator body into the seat, and a closed position, wherein the first and second guard members at least partially encircle the insulator body to capture the insulator body in the seat; and an actuator member configured to be inserted between the first and second guard members in the open position, and configured to force the first and second guard members to move from the open position to the closed position when forcibly displaced radially to an installed position;

wherein:

the first and second guard members are pivotably connected to rotate relative to one another about a pivot axis between the open position and the closed position;

the actuator member is configured, when forced radially to the installed position, to force the first and second guard members to rotate about the pivot axis from the open position to the closed position; and the actuator member has a leading engagement width proximate the pivot axis and a trailing engagement width distal from the pivot axis, and the trailing engagement width is greater than the leading engagement width.

2. The wildlife guard assembly of claim 1 wherein the actuator member and the pivot axis are located on a same side of the seat.

3. The wildlife guard assembly of claim 1 wherein the trailing engagement width is at least 700 percent greater than the leading engagement width.

4. The wildlife guard assembly of claim 1 including a retainer mechanism to secure the actuator member in the installed position.

5. The wildlife guard assembly of claim 1 wherein at least one of the first and second guard members includes a guide rail and the actuator member is slidably mounted on the guide rail.

6. The wildlife guard assembly of claim 1 including a stabilizer feature integral with the first guard member opposite the actuator member to align and/or stabilize the first and second guard members with respect to one another when the first and second guard members are in the closed position.

7. The wildlife guard assembly of claim 1 wherein the first and second guard members are each substantially planar.

8. The wildlife guard assembly of claim 1 wherein the first and second guard members each include a shell body and, when the first and second guard members are in the closed position, the shell bodies thereof collectively define an enclosure surrounding at least a portion of the insulator body.

9. A method for installing a wildlife guard assembly on an electrical insulator body, the method comprising:

providing first and second guard members defining a seat to receive the insulator body, the first and second guard members being connected to one another to permit relative movement between an open position, wherein the first and second guard members define a sideward opening to laterally receive the insulator body into the seat, and a closed position, wherein the first and second guard members at least partially encircle the insulator body to capture the insulator body in the seat;

providing an actuator member configured to be inserted between the first and second guard members in the open position;

with the first and second guard members in the open position, placing the first and second guard members on the insulator body such that the insulator body is received laterally through the sideward opening into the seat; and thereafter with the first and second guard members mounted on the insulator body in the open position, forcing the actuator member radially between the first and second guard members to an installed position and thereby forcing the first and second guard members to move from the open position to the closed position;

wherein:

the first and second guard members are pivotably connected to rotate relative to one another about a pivot axis between the open position and the closed position;

forcing the actuator member radially to the installed position threes the first and second guard members to rotate about the pivot axis from the open position to the closed position; and the method includes suspending and forcing the actuator member into the installed position using a hotstick engaging a handling feature forming a part of the actuator member.

10. The method of claim 9 wherein the actuator member and the pivot axis are located on a same side of the seat.

11. The method of claim 9 wherein the actuator member has a leading engagement width proximate the pivot axis and a trailing engagement width distal from the pivot axis, and the trailing engagement width is greater than the leading engagement width.

12. The method of claim 9 wherein the actuator member is secured in the installed position by at least one barb when in the installed position.

13. The method of claim 9 wherein at least one of the first and second guard members includes a guide rail and forcing the actuator member radially to the installed position includes sliding the actuator member on the guide rail.

14. The method of claim 9 wherein:

the insulator body includes a core and a plurality of skirts spaced apart along a length of the core and extending radially outwardly from the core; and at least one of the first and second guard members includes a retention portion that is received between two adjacent skirts of the plurality of skirts when the first and second guard members are installed on the insulator body in the closed position.

15. The method of claim 9 wherein the first and second guard members are each substantially planar.

16. The method of claim 9 wherein the first and second guard members each include a shell body and, when the first and second guard members are in the closed position, the shell bodies thereof collectively define an enclosure surrounding at least a portion of the insulator body.

17. The method of claim 9 including a step of mounting the actuator member on at least one of the first and second guard members and between the first and second guard members in the open position prior to placing the first and second guard members on the insulator body.

18. A method for installing a wildlife guard assembly on an electrical insulator body, the method comprising:

providing first and second guard members defining a seat to receive the insulator body, the first and second guard members being connected to one another to permit relative movement between an open position, wherein the first and second guard members define a sideward opening to laterally receive the insulator body into the seat, and a closed position, wherein the first and second guard members at least partially encircle the insulator body to capture the insulator body in the seat;

providing an actuator member configured to be inserted between the first and second guard members in the open position;

with the first and second guard members in the open position, placing the first and second guard members on the insulator body such that the insulator body is received laterally through the sideward opening into the seat; and thereafter with the first and second guard members mounted on the insulator body in the open position, forcing the actuator member radially between the first and second guard members to an installed position and thereby forcing the first and second guard members to move from the open position to the closed position;

wherein:

the first and second guard members are pivotably connected to rotate relative to one another about a pivot axis between the open position and the closed position;

forcing the actuator member radially to the installed position forces the first and second guard members to rotate about the pivot axis from the open position to the closed position; and the actuator member is secured in the installed position by at least one barb when in the installed position.

19. A method for installing a wildlife guard assembly on an electrical insulator body, the method comprising:

providing first and second guard members defining a seat to receive the insulator body, the first and second guard members being connected to one another to permit relative movement between an open position, wherein the first and second guard members define a sideward opening to laterally receive the insulator body into the seat, and a closed position, wherein the first and second guard members at least partially encircle the insulator body to capture the insulator body in the seat;

providing an actuator member configured to be inserted between the first and second guard members in the open position;

with the first and second guard members in the open position, placing the first and second guard members on the insulator body such that the insulator body is received laterally through the sideward opening into the seat; and thereafter with the first and second guard members mounted on the insulator body in the open position, forcing the actuator member radially between the first and second guard members to an installed position and thereby forcing the first and second guard members to move from the open position to the closed position;

wherein:

the first and second guard members are pivotably connected to rotate relative to one another about a pivot axis between the open position and the closed position;

forcing the actuator member radially to the installed position forces the first and second guard members to rotate about the pivot axis from the open position to the closed position; and at least one of the first and second guard members includes a guide rail and forcing the actuator member radially to the installed position includes sliding the actuator member on the guide rail.

* * * * *